US008042497B2

(12) United States Patent
Warren et al.

(10) Patent No.: US 8,042,497 B2
(45) Date of Patent: Oct. 25, 2011

(54) STEAM GENERATOR ARRANGEMENT

(75) Inventors: Eric M. Warren, Medina, OH (US); Kevin A. Larson, Clinton, OH (US); Thomas A. Laursen, Canton, OH (US); Christopher J. Thompson, Cuyahoga Falls, OH (US); Shan A. Shanmugavel, Wadsworth, OH (US)

(73) Assignee: Babcock & Wilcox Power Generation Group, Inc., Barberton, OH (US)

( * ) Notice: Subject to any disclaimer, the term of this patent is extended or adjusted under 35 U.S.C. 154(b) by 707 days.

(21) Appl. No.: 12/101,513

(22) Filed: Apr. 11, 2008

(65) Prior Publication Data

US 2008/0251037 A1 Oct. 16, 2008

Related U.S. Application Data

(60) Provisional application No. 60/911,425, filed on Apr. 12, 2007.

(51) Int. Cl.
*F22B 23/04* (2006.01)

(52) U.S. Cl. ..... 122/209.1; 122/479.5; 122/213

(58) Field of Classification Search ..... 122/135.2, 122/209.1, 213, 223, 490, 484, 479.5
See application file for complete search history.

(56) References Cited

U.S. PATENT DOCUMENTS 2,886,013 A 8/1951 Chan
2,985,152 A 11/1951 Paulison, Jr.
2,905,154 A * 9/1959 Schaap ..... 122/478
3,097,631 A * 7/1963 Martin ..... 122/235.33
3,150,643 A * 9/1964 Parmakian ..... 122/479.6
3,345,975 A 10/1967 Stevens et al.
4,160,009 A 7/1979 Hamabe
4,245,569 A 1/1981 Fallon, III
4,403,571 A 9/1983 Kochey, Jr.
4,478,809 A 10/1984 McAlister et al.
4,738,226 A 4/1988 Kashiwazaki et al.
5,133,943 A * 7/1992 Abdulally ..... 422/145
5,140,950 A * 8/1992 Abdulally ..... 122/4 D
5,247,907 A 9/1993 Lee et al.
5,423,272 A 6/1995 Dunn, Jr. et al.
5,555,849 A 9/1996 Wiechard et al.
5,775,266 A 7/1998 Ziegler
5,911,956 A 6/1999 Lamare et al.
6,609,483 B1 8/2003 Albrecht et al.
6,748,880 B2 * 6/2004 DeSellem ..... 110/345
6,863,523 B2 3/2005 Giella
7,021,248 B2 4/2006 McNertney, Jr. et al.
2007/0261646 A1 11/2007 Albrecht
2007/0261647 A1 11/2007 Albrecht et al.

* cited by examiner

*Primary Examiner* — Gregory A Wilson
(74) *Attorney, Agent, or Firm* — Eric Marich

(57) ABSTRACT

A method and apparatus effectively bypasses flue gas through or around selected boiler convection heat transfer tube banks within a new or existing boiler flue. Heat transfer tubes are removed, or omitted in the design of a new boiler flue, forming one or more voids at one or more locations within the tube banks. A bypass flue or conduit is formed within each void, for example using steel plates, along with existing flue walls, or using an integral sleeve. A wall of the bypass flue may include water or steam-cooled tubes. Dampers may be installed at either end of or within the bypass flue to control the amount of flue gas directed through each bypass flue.

5 Claims, 6 Drawing Sheets

STEAM GENERATOR ARRANGEMENT

CROSS-REFERENCE TO RELATED APPLICATION

Priority is claimed to U.S. provisional patent application No. 60/911,425, filed Apr. 12, 2007, the entire disclosure of which is incorporated herein by reference.

FIELD AND BACKGROUND OF THE INVENTION

The present invention relates generally to the field of Selective Catalytic Reduction (SCR) gas inlet temperature control for boilers with a parallel convection back pass and, in particular, to a system and method for maintaining the combustion or flue gas entering the SCR system at or above a minimum injection temperature and minimum continuous operating temperature as specified by the supplier of the catalyst used in the system, even when operating the boiler at reduced loads.

Selective Catalytic Reduction (SCR) systems introduce ammonia into the flue gas upstream of a reactor filled with multiple blocks of catalyst, where nitrogen oxides (NOx) produced during combustion are reduced to nitrogen and water when combined with the ammonia on the active sites contained within the catalyst's micropore structure. System operation must proceed per the catalyst supplier's instructions; these instructions include limiting ammonia introduction into the flue gas only when the average flue gas temperature entering the SCR reactor meets or exceeds a minimum injection temperature for limited operation or a minimum continuous operating temperature for unlimited operation, up to the maximum allowable gas temperature. These minimum temperatures are set by the sulfur content of the fuel and the resulting expected sulfur trioxide ($SO_3$) concentration in the products of combustion exiting the boiler economizer. Typically, the minimum injection temperature for limited operation is within a temperature range of about 520 degrees F. to about 620 degrees F., while the minimum continuous operating temperature for unlimited operation is within a temperature range of about 540 degrees F. to about 640 degrees F.

Typically, at a boiler or steam generator unit's maximum continuous rating (MCR), the flue gas temperature entering the SCR reactor meets or exceeds the catalyst supplier's minimum injection temperature and minimum continuous operating temperature. As boiler load decreases, the boiler exit gas temperature may fall to a temperature between the minimum injection temperature and minimum continuous operating temperature or even below the minimum injection temperature at varying loads depending on the fuel, firing method, and overall unit operation. For reactor inlet temperatures between the minimum injection temperature and minimum continuous operating temperature, ammonia injection may occur for only a limited time before the reagent must be shut off or gas temperature must be increased above the catalyst supplier's specified recovery temperature for an equivalent time that the unit was operated between the minimum injection temperature and minimum continuous operating temperature. If the average reactor inlet gas temperature falls below the minimum injection temperature, the reagent must be immediately shut off. In order to maintain the average reactor inlet gas temperature above the minimum injection temperature and minimum continuous operating temperature at lower boiler loads, the current industry practice has been to use an external economizer gas bypass. The external economizer gas bypass reroutes a portion of the hot gas exiting either the primary superheat or reheat section of the parallel convection back pass around the respective economizer heat transfer surface, where it is re-introduced into the main gas stream in order to maintain elevated gas temperatures entering the SCR reactor at reduced boiler loads.

SCRs can be applied to existing boilers or steam generators as a retrofit application, or they can be applied as part of new power plant installations. In some instances, the boiler/SCR arrangement has already been designed, and since many materials are already procured and fabricated, designers face the issue of limited space. This is typical of retrofit applications, except that on retrofits generally there is some freedom to relocate the SCR.

Conventional external boiler convection pass, gas by-pass systems are typically designed to make new penetrations in the casing of the boiler before and behind the convection pass tube banks that are intended to have the flue gas bypassed at reduced boiler loads. Typically this requires boiler casing penetrations, penetration seals, and gas flues external to the boiler setting that connect the take-off point to the desired downstream re-injection point of the boiler. Dampers, hangers, expansion joints, and structural steel used for support of the structure are also required for this conventional boiler convection pass heat transfer surface arrangement. There are undesirable aspects to this including boiler flyash buildup in the external bypass or "jumper" flues. In addition, there is the potential for leakage of the flue gas over time which reduces boiler heat transfer efficiency when the gas by-pass system is desired to be out of service and all the flue gas flow is desired to flow across the convection heat transfer surface at full load operation.

Additional details of SCR systems for $NO_x$ removal are provided in Chapter 34 of *Steam/its generation and use,* 41st Edition, Kitto and Stultz, Eds., Copyright © 2005, The Babcock & Wilcox Company, the text of which is hereby incorporated by reference as though fully set forth herein. Flue gas temperature control using conventional economizers are described in U.S. Pat. Nos. 7,021,248 to McNertney, Jr. et al. and 6,609,483 to Albrecht et al., the texts of which are hereby incorporated by reference as though fully set forth herein. Flue gas temperature control using an internal flue gas bypass are also described in U.S. Pat. Nos. 4,738,226 to Kashiwazaki et al. and 6,748,880 to DeSellem.

SUMMARY OF THE INVENTION

The present invention is drawn to an improved apparatus and method for effectively by-passing boiler flue gas internally through or around selected boiler convection heat transfer tube banks within a new or existing boiler setting. Heat transfer tubes are removed, or are omitted in the design of a new boiler flue, at one or more locations within the tube banks. One or more voids are thus formed between or along the tube banks and a bypass flue or conduit is formed within each void, for example using steel plates, along with existing flue walls, or using an integral sleeve. A wall of the bypass flue may include water-cooled or steam-cooled tubes, or a particular interior wall arrangement. Dampers may be installed to control the amount of flue gas directed through each bypass flue, and are preferably cycled periodically to dislodge fly ash deposited by the flue gas.

The invention advantageously may be used to maintain the flue gas temperature at the convection pass outlet at or above a desired level as boiler load varies. This allows ammonia injection and thus $NO_x$ reduction due to the SCR at lower loads, where without a bypass no reduction would normally occur.

The invention advantageously makes use of limited space as defined by the SCR arrangement while maximizing the distance between bypassed flue gas re-introduction to the main gas stream and the reactor inlet.

Accordingly, one aspect of the invention is drawn to an internal gas bypass arrangement for a boiler, particularly in a boiler flue of a boiler for producing a flowing flue gas, the boiler flue having a plurality of tube banks having and a tube bank inlet and a tube bank outlet within parallel gas flow paths within the boiler setting. Gas flow through each of the parallel gas flow paths is controlled by individual outlet flow control dampers. The internal gas bypass arrangement comprises one or more bypass flues in fluid communication with the boiler flue and disposed through or around at least one tube bank within a flow controlled gas path. The bypass flues are for directing flue gas from the tube bank inlet through or around the tube bank to the tube bank outlet, and the one or more bypass flues are fully contained within the parallel gas flow paths within the boiler setting.

Another aspect of the invention is drawn to a method of controlling flue gas flowing through a boiler flue having parallel gas flow paths. Superheater surface is located in one gas flow path and reheater surface is located in another gas flow path. Outlet flow control dampers are provided in both the superheater and reheater gas flow paths, and within the boiler setting of a boiler, and the boiler flue has a plurality of tube banks and a tube bank inlet and a tube bank outlet within the parallel gas flow paths. An internal gas bypass arrangement is fully contained within the boiler setting including one or more bypass flues in fluid communication with the boiler flue and disposed through or around at least one tube bank for directing flue gas from the tube bank inlet to the tube bank outlet. The one or more bypass flues each have a control damper located at one of either end of or within the bypass flue. The method comprises the steps of modulating the outlet flow control dampers in the superheater and reheater gas flow paths to control relative amounts of flue gas flowing therethrough to maintain at least one of superheater and reheater steam temperatures at desired values. Simultaneously, modulating the control dampers in the one or more bypass flues is performed to control the amount of flue gas flowing across the at least one tube bank to maintain a temperature of the flue gas exiting from the boiler flue at a desired value over a desired operating load range of the boiler.

Yet another aspect of the present invention is drawn to a method of modifying a boiler flue of a boiler to provide an internal gas bypass arrangement. In this case, the boiler flue has parallel flow gas paths with superheater surface located in one gas flow path, reheater surface located in another gas flow path and outlet flow control dampers provided in the superheater and reheater gas flow paths. The boiler flue has a plurality of tube banks having multiple tube bank inlets and multiple tube bank outlets within the parallel gas flow paths within the boiler setting. The modification is accomplished by: removing tubes from at least one of the tube banks to create a void within the tube bank; installing a bypass flue within the boiler setting in the void from the inlet of the tube bank to the outlet of the tube bank for transporting flue gas there through; and installing a damper within the bypass flue for controlling a pre-selected portion of the flowing flue gas through the bypass flue.

The various features of novelty which characterize the invention are pointed out with particularity in the claims annexed to and forming part of this disclosure. For a better understanding of the present invention, and the operating advantages attained by its use, reference is made to the accompanying drawings and descriptive matter forming a part of this disclosure, in which a preferred embodiment of the invention is illustrated.

BRIEF DESCRIPTION OF THE DRAWINGS

In the accompanying drawings, forming a part of this specification, and in which like reference numerals shown in the drawings designate like or corresponding parts throughout the same.

DESCRIPTION OF THE PREFERRED EMBODIMENTS

As used in the present disclosure, and as is known to those skilled in the art, the term boiler is used herein to broadly refer to apparatus used for generating steam and may include both drum-type boilers and those of the once-through type. For a general description of such types of boilers or steam generators, the reader is referred to the aforementioned STEAM 41st reference, particularly the Introduction and Selected color plates, and Chapters 19, 20, and 26, the text of which is hereby incorporated by reference as though fully set forth herein.

The internal gas bypass method and apparatus described in the present disclosure can achieve the desired functional requirements and is particularly suited to applications where reduced load SCR operation is necessary or required, and where without bypass such reduced load operation would not be possible due to low average reactor gas inlet temperature. The present invention facilitates meeting unit emissions limits even with limited space considerations, for both retrofit and new SCR/boiler installations. In the present disclosure and FIGS., RH is an abbreviation for reheater, ECON is an abbreviation for economizer, PSH is an abbreviation for primary superheater, and LHS or RHS are abbreviations for left-hand side and right-hand side.

Referring now to FIGS. 1, 2, 3A and 3B, one aspect of the invention is an apparatus and method of effectively by-passing boiler flue gas 11 through or around some of the convection heat transfer tube banks 12 of convection pass 10 within the existing boiler flue 15. As is known to those skilled in the art, the convection pass 10 of the existing boiler flue 15 is comprised of two or more separate, parallel flue gas passes separated by a baffle wall, and is sometimes referred to as a "parallel back-end" convection pass. Gas proportioning dampers, as described below, are used to proportion the flow of flue gas 11 across each path, and the convection heat transfer surfaces located in each path, in order to control the reheat (RH) and superheat (SH) temperatures.

Figure 3A:
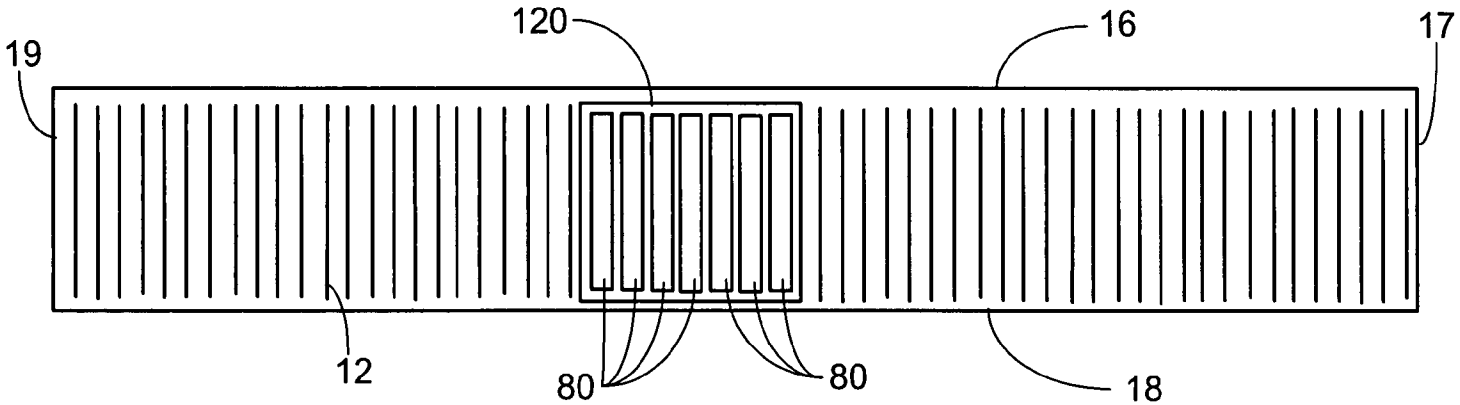
FIG. 3A is a schematic plan view of the boiler or steam generator convection pass of FIG. 1.
Figure 3B:
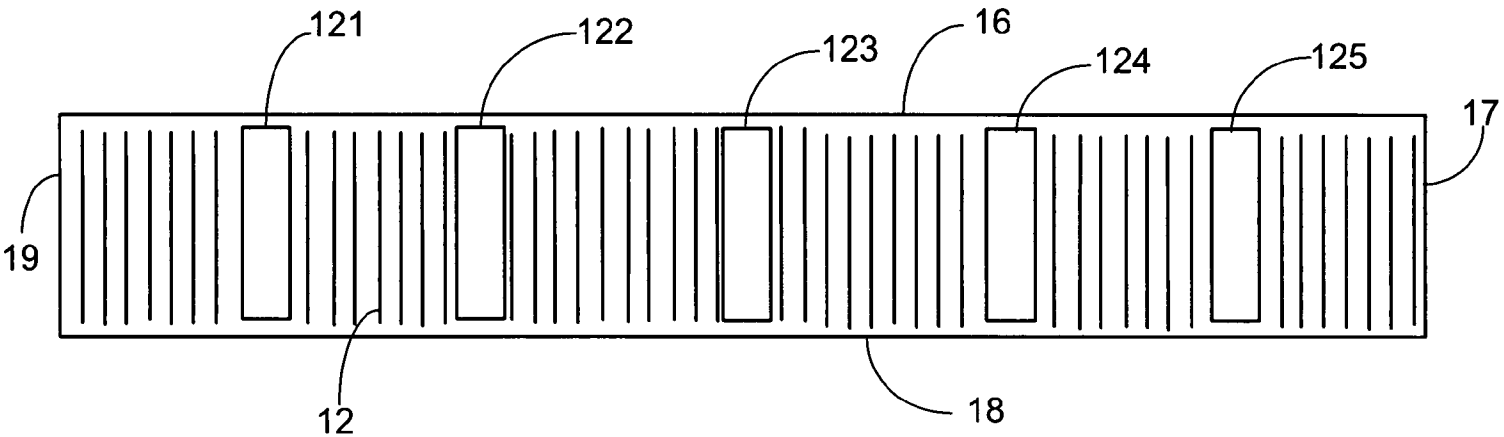
FIG. 3B is a schematic plan view of the boiler or steam generator convection pass of FIG. 2.

Effectively by-passing the boiler flue gas 11 through or around some of the convection heat transfer tube banks 12 of convection pass 10 within the existing boiler flue 15 involves either designing into a new boiler or removing from an existing boiler, convection pass tube banks 12 at incremental locations across the width of the boiler flue 15. In the place of the tubes at these locations, voids 110 are created between the tube banks 12. Advantageously, flat steel plates 130 made of materials suitable for the temperature, pressure, and flue gas chemistry conditions are to be attached by one of various desirable attachment methods to each side of the void or "lane" 110 in the convection pass tube banks 12. These plates 130 would extend from the top of the inlet tube bank 13 to the bottom of the outlet of the tube bank 14 that is desired to be by-passed (for example, two plates 130 and the existing convection pass enclosure walls, such as front wall 16 and rear wall 18 of boiler flue 15, could form the enclosure of the bypass flue generally designated 100). The bypass flue 100 could also be constructed as an integral flue sleeve or insert 120, as shown in FIG. 3A, to totally encase the flue gas path. Computational heat transfer modeling tools will be employed to determine the optimal cumulative flow area and number of gas bypass lanes to be installed, e.g. 121-125 shown in FIG. 3B. At either end, or in any space located between the inlet 140 and outlet 180 of the individual gas bypass flues 100, flow control dampers, generally designated 80, will be employed to close off flow when it is desirable to have the bulk of the flue gas 11 flowing across the convection heat transfer tube bank surfaces 12, such as economizers 61 and 62. This would be at full boiler load or at other elevated boiler loads, for example. The dampers 80 would be used to open up the gas flow path through the bypass flue 100 formed by the plates 130 or flue sleeve 120. By constricting the gas flow across all other convection heat transfer surface by means of other existing or newly-supplied gas biasing dampers 86, 87, adequate flue gas pressure is developed in order to drive the flue gas flow through the path of least resistance through the open gas bypass flues, such as 101-105, to the outlet 14 of the downstream heat transfer bank that is being by-passed.

Using this arrangement, the flue gas 11 can be effectively bypassed through the convection heat transfer surface 12 and cause the exit gas temperature to be higher due to the lack of convective heat transfer from the flue gas 11 to the convection tube banks. This gas bypass operation is desirable at reduced boiler loads in order to maintain the average flue gas temperatures entering the SCR reactor at or above the minimum continuous operating temperature, so as to allow ammonia injection and subsequent $NO_x$ reduction to occur without limitations on operation.

One advantage of the present invention is achieved due to the savings in the incremental cost of the conventional external flue gas "jumper flue" arrangement located outside of the boiler setting. This includes large openings in the boiler at the flue gas take-off and re-injection points, large flues that will require hangers (designed for the weight of the flue and any potential ash loading), support steel, insulation, and lagging. Relatively large tight-shutoff dampers are also required for each conventional external by-pass flue that acts to isolate the flue gas flow through the gas by-pass flue when it is not desirable (i.e., at higher boiler loads). This external flue will have the tendency to fill up with fly ash in any horizontal sections, potentially rendering it completely ineffective in conveying flue gas for which it was designed. This conventional arrangement also will potentially expose the flue metal material to accelerated corrosion conditions by condensation and subsequent acid dew point corrosion since it will constantly be exposed to the chemistry of the flue gas and the flyash that inevitably settles out in the flue (under-deposit corrosion).

The inventive arrangement requires the replacement of, or original design of, voids or "lanes" 110 in the convection heat transfer tube bank surface 12 with newly designed and installed flue sleeves 120 or plates 130 to create a gas bypass flue or conduit 100 through the convection heat transfer tube bank 12 at one or multiple locations across the width of the boiler flue 15. The materials of selection for the plates 130 or sleeves 120 will be based on the operating conditions and flue gas chemistry when the boiler is cycled in and out of operation.

The required dampers 81-85 will be located within or at either the upstream ends 140 or downstream ends 180 of the bypass flues 101-105, and will be driven by actuators or motors 90 either linked through multiple linkage arrangements or else operated by individual actuators. It should be noted that these dampers 81-85 are preferably to be located at the same location as the existing boiler flue gas biasing dampers 86, 87 for ease of maintenance, and minimization of interferences with other equipment. It should also be noted that to combat the build-up of fly ash on the upstream side of the damper, the damper actuator control system should be designed to periodically initiate sequenced, intermittent operation of the dampers 81-85, either individually or through linked pairs, threesomes, or foursomes. This operation will be necessary in order to dump any accumulated fly ash back into the flue gas flow 11 where it will be swept downstream and collected by downstream particulate removal equipment. The frequency of this damper ash dump sequence will be related to the quantity of fly ash in the gas stream, and the rate at which it builds up above the dampers. The dampers 81-85 in the present invention will involve a plurality of flues, e.g. 101-105 and dampers so that only a minor portion of the overall boiler flue gas 11 will be disrupted over very short time periods in order to accomplish this individual or linked damper flyash clearing operation. It is believed that this flyash clearing operation (intermittent stroking of the damper actuators) will have to be an ongoing operation whenever the boiler is on-line and generating fly-ash-laden flue gas.

Figure 1:
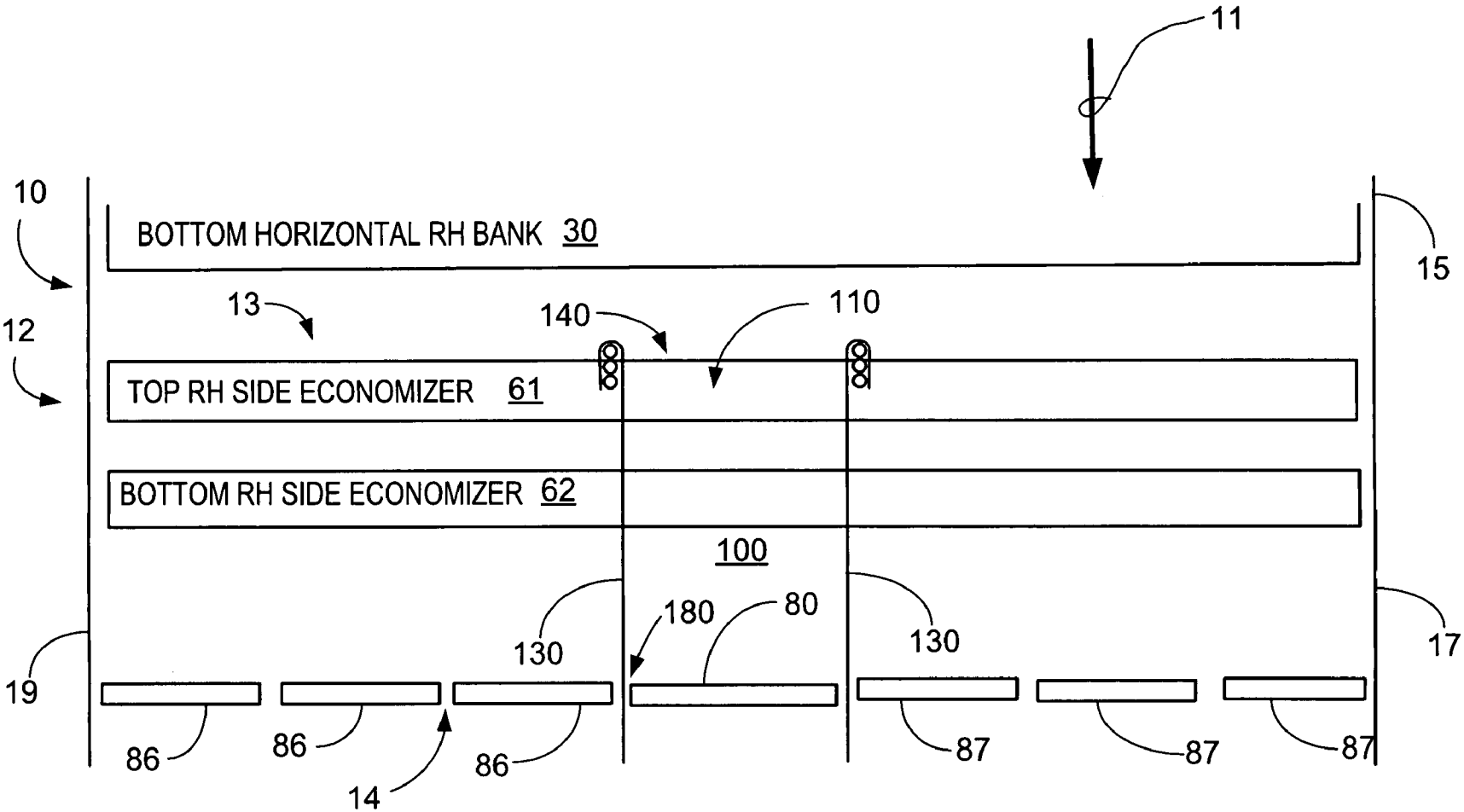
FIG. 1 is a schematic sectional rear view of a boiler or steam generator convection pass illustrating a first embodiment of the invention, employing a single internal bypass flue.
Figure 2:
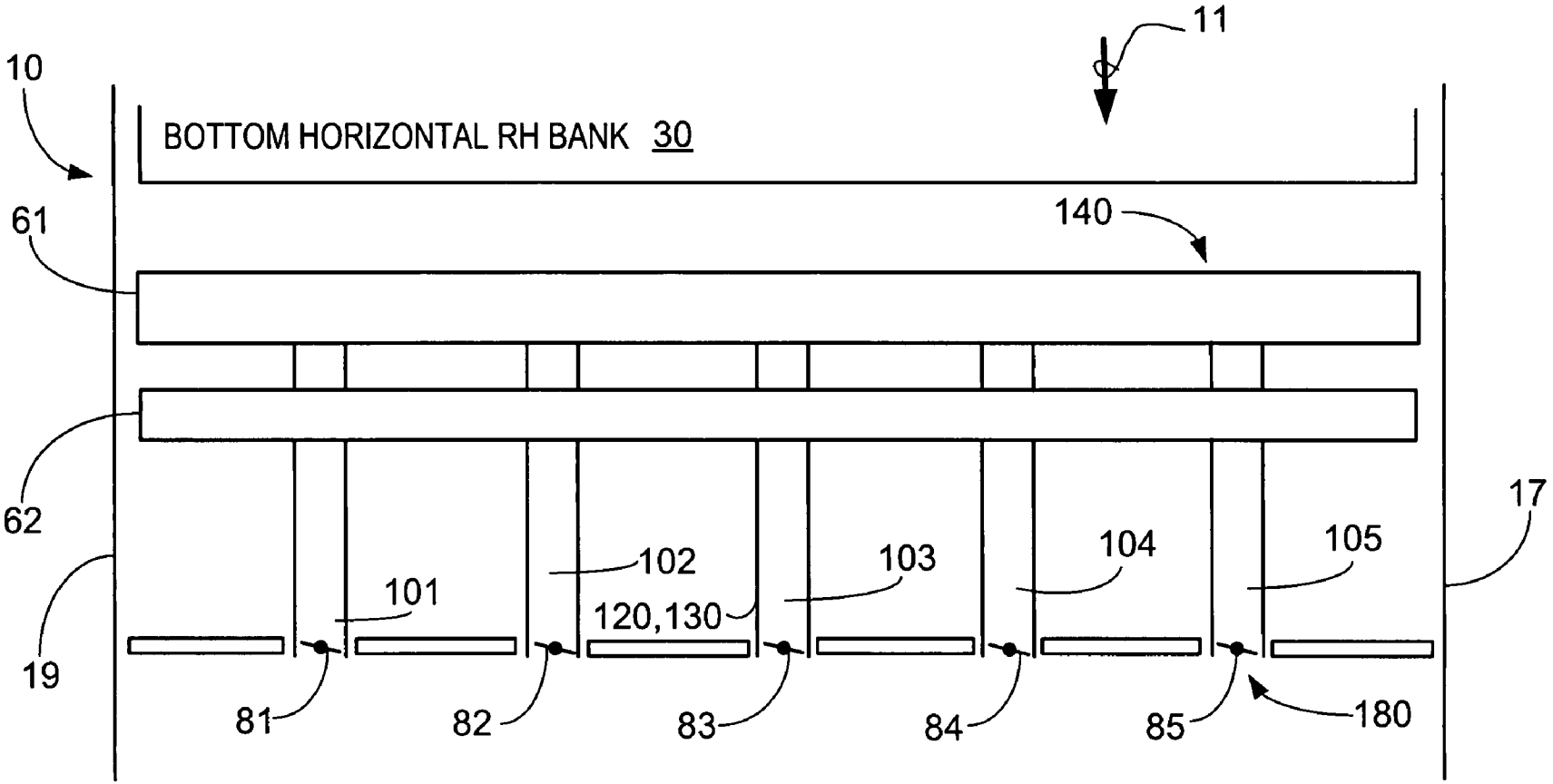
FIG. 2 is a schematic sectional rear view of a boiler or steam generator convection pass illustrating a second embodiment of the invention, employing plural internal bypass flues.
Figure 4:
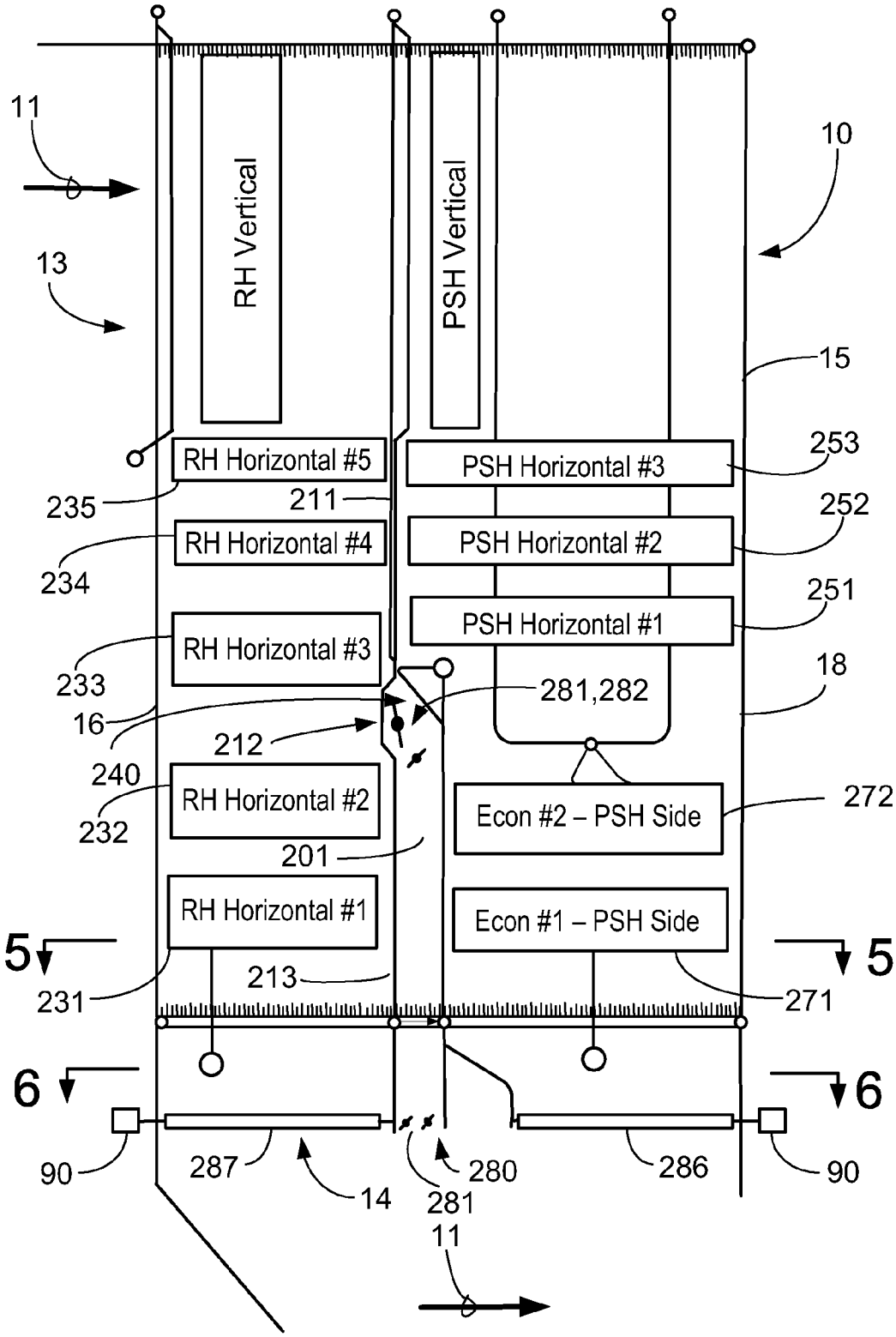
FIG. 4 is a schematic sectional side view of a boiler or steam generator convection pass illustrating a variation of the second embodiment of the invention employing plural internal bypass flues.
Figure 5:
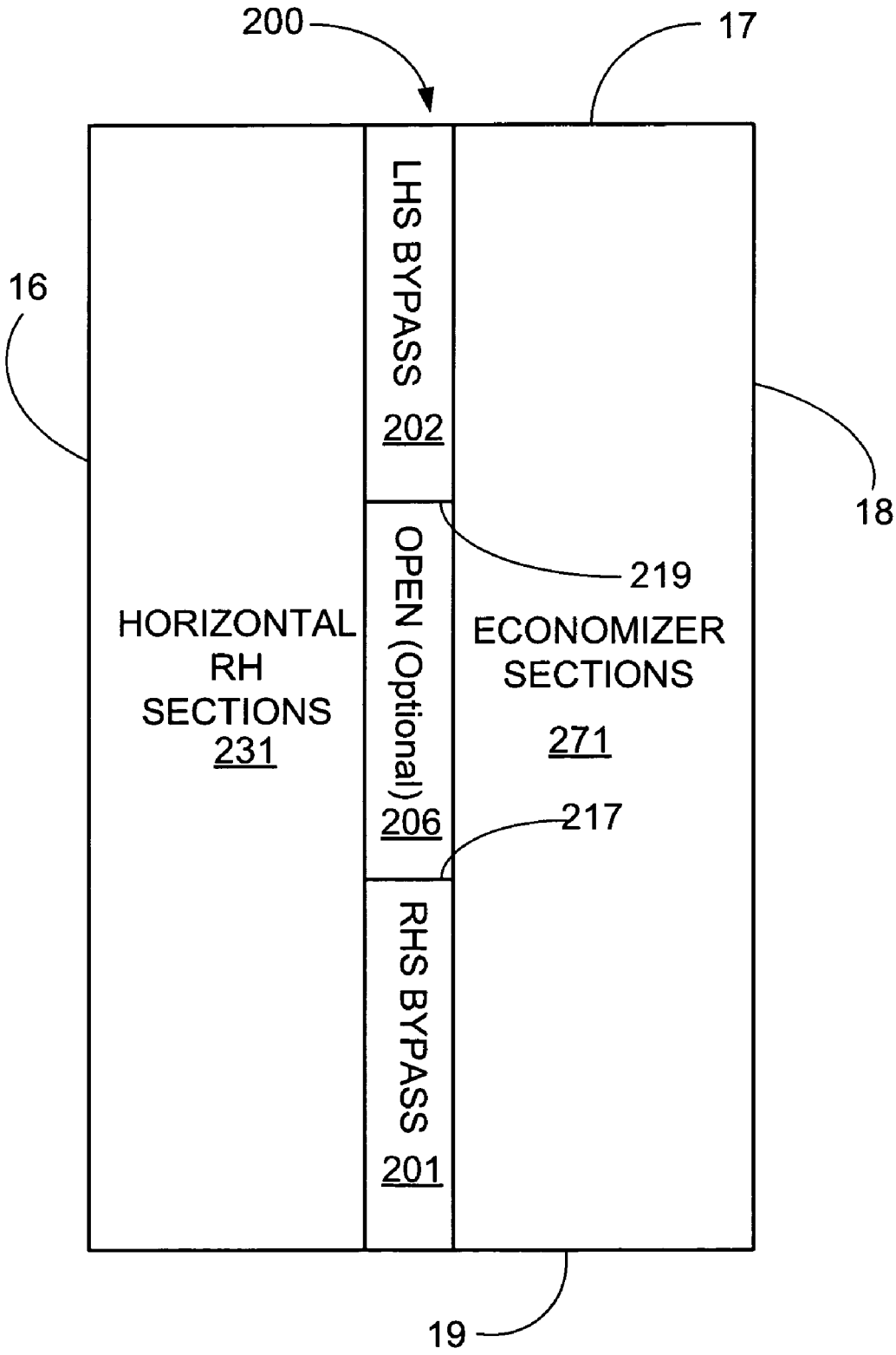
FIG. 5 is a schematic plan view of the boiler or steam generator convection pass of FIG. 4 taken along line 5-5.
Figure 6:
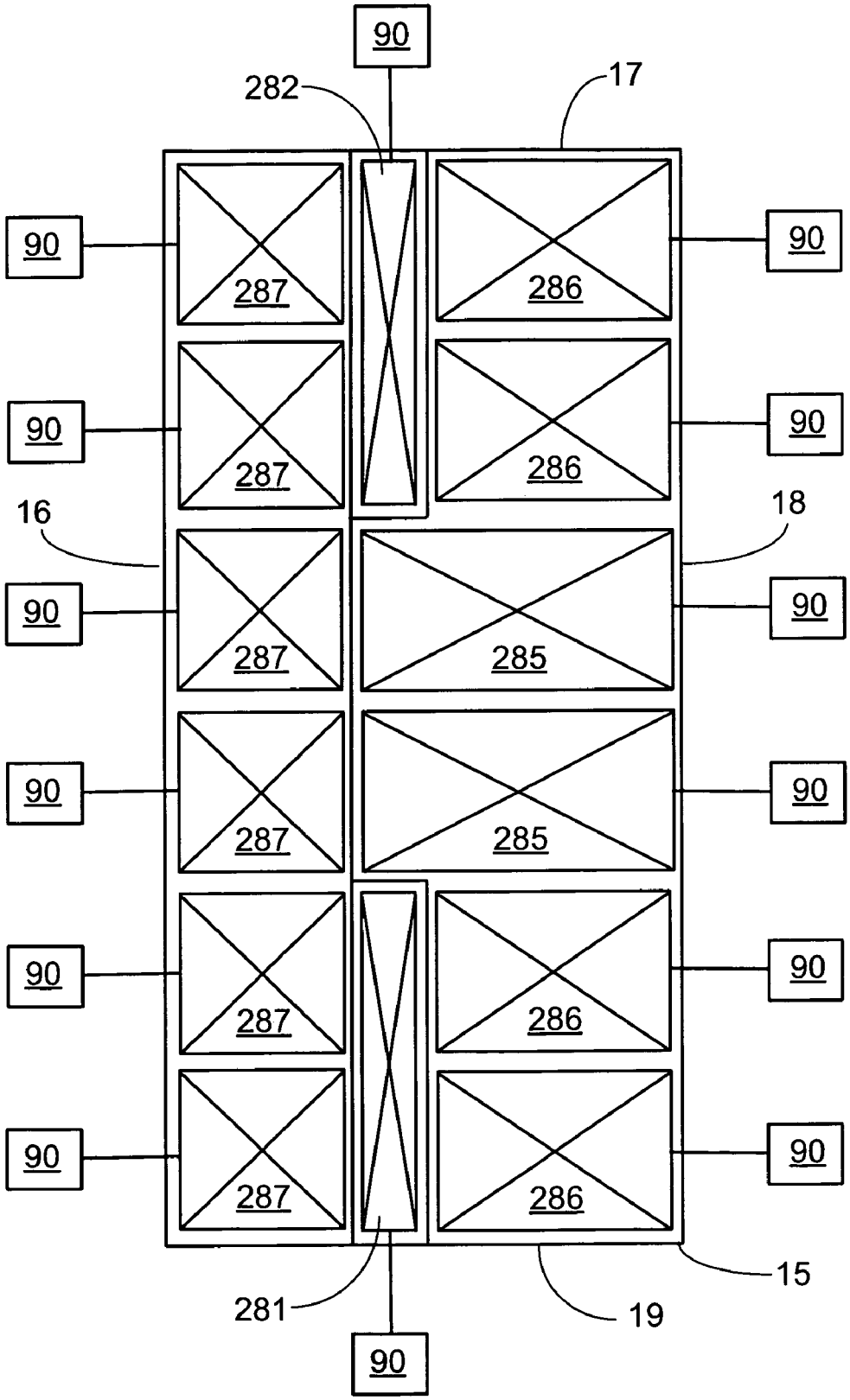
FIG. 6 is a schematic plan view of the boiler or steam generator convection pass of FIG. 4 taken along line 6-6.

FIGS. 4-6 depict a variation of the embodiment of FIG. 2 employing plural bypass flues. In contrast with FIG. 2, wherein voids 110 are created at incremental locations across the width of boiler flue 15, FIGS. 4-6 depict a variation in which bypass flues, such as parallel bypass flues 201, 202, are located transverse to the convection pass tube banks along either end of the bank heating surface.

Convection pass 10 has a tube bank inlet 13 and a tube bank outlet 14 connected by a boiler flue 15 having a front wall 16, a rear wall 18, and side walls 17, 19. In operation flue gas 11 flows in boiler flue 15 of convection pass 10 through horizontal reheaters 231-235, and also flows through a parallel flow path containing horizontal primary superheaters 251-253 and economizers 271, 272.

Bypass flues 201, 202 are designed to incorporate membrane constructed enclosure tube surface 213. Enclosure surface 213 is preferably made of water-cooled or steam-cooled tubes extending across the entire width of boiler flue 15. Interior side walls 217, 219 of bypass flues 201, 202 are preferably formed from pairs of plates joined together at bypass inlet 240 and forming a void 206 there between. Dampers 281, 282 control the flue gas flow rate through associated bypass flues 201, 202. Dampers 281, 282 may be oriented horizontally (preferably) or vertically and located at either end or in any space located between the inlet 240 and outlet 280 located near the bottom of flue 15 and bypass flues 201, 202.

FIG. 6 depicts a damper arrangement suitable for use in the variation of the invention shown in FIGS. 4-5. In addition to the gas biasing dampers 281 and 282 described above, gas biasing dampers 285, 286 are arranged in the primary superheater flow path and gas biasing dampers 287 are arranged in the reheater flow path. Motors or actuators 90 control the dampers thereby adjusting the flow rate of flue gas 11 among the various parallel flow paths.

In the above arrangement, the flue gas 11 is effectively bypassed internally around the heat transfer surface and reintroduced into the main flue gas stream such that the combined, average gas temperature is higher than it otherwise would be, due to minimal cooling of the bypassed gas because it encounters no or very little heat transfer surface.

Once the internal gas bypass arrangement is provided, the flue gas flowing through the boiler would be controlled in straightforward fashion as follows. The outlet flow control dampers 86, 87 or 285, 286 and 287 in the superheater and reheater gas flow paths are used to control relative amounts of flue gas 11 flowing therethrough to maintain at least one of superheater and reheater steam temperatures at desired values. Simultaneously, the control dampers 80 or 81-85 or 281, 282 in the one or more bypass flues 100 or 101-105 or 201, 202, are modulated to control the amount of flue gas flowing across the at least one tube bank to maintain a temperature of the flue gas exiting from the boiler flue 15 at a desired value over a desired operating load range of the boiler. Advantageously, since the boiler flue 15 provides the flue gas 11 to a downstream selective catalytic reduction (SCR) device, the control dampers in the one or more bypass flues are modulated to maintain a temperature of the flue gas exiting from the boiler flue 15 at or above a minimum ammonia injection temperature for limited operation of the SCR or at or above a minimum continuous operating temperature for unlimited operation of the SCR, up to the maximum allowable gas temperature of the SCR.

There may be a priority of control operations employed, such as modulating the outlet flow control dampers in the superheater and reheater gas flow paths according to a master demand control signal for steam temperature control tuned over the boiler operating load range. Then, the control dampers in the one or more bypass flues are modulated in accordance with a secondary override control signal to maintain a temperature of the flue gas exiting from the boiler flue and entering the SCR at a desired level. Modulating the outlet flow control dampers in the superheater and reheater gas flow paths may be performed according to a feed forward control method. Additionally, modulating the control dampers in the one or more bypass flues may be performed according to an open/closed control method. In addition, all of the dampers may be modulated or cycled periodically to dislodge fly ash deposited by the flue gas 11.

The present invention may advantageously be used and applied to existing boilers or steam generators to provide an internal gas bypass arrangement. In many situations there is an existing boiler and associated boiler flue. The boiler flue has parallel flow gas paths with superheater surface located in one gas flow path, and reheater surface located in another gas flow path. Outlet flow control dampers are provided in both the superheater and reheater gas flow paths, and there is a plurality of tube banks having multiple tube bank inlets and multiple tube bank outlets within the parallel gas flow paths within the boiler setting. The present invention may thus be applied by removing tubes from at least one of the tube banks to create a void within the tube bank. The bypass flue is then installed entirely within the boiler setting in the void from the inlet of the tube bank to the outlet of the tube bank for transporting flue gas there through. In order to provide for flow control of the flue gas through the bypass flue, a damper is installed within the bypass flue for controlling a pre-selected portion of the flowing flue gas through the bypass flue.

Overall, the method and apparatus according to the present invention arrangement is a much more cost effective means of by-passing flue gas around the heat transfer tube banks internal to the existing boiler setting than conventional "jumper" flues external to the boiler. The present invention will have little impact on any potential interference with other boiler or auxiliary equipment. No additional hangars, supports, external flues, expansion joints, insulation, or lagging are required when utilizing this invention to effect the desirable gas bypass function of its design.

While specific embodiments of the invention have been shown and described in detail to illustrate the application of the principles of the invention, it will be understood that the invention may be embodied otherwise without departing from such principles. For example, the present invention may be applied to new boiler or steam generator construction involving selective catalytic reduction reactors or to the replacement, repair or modification of existing boilers or steam generators where selective catalytic reduction reactors have been installed as a retrofit. In some embodiments of the invention, certain features of the invention may sometimes be used to advantage without a corresponding use of the other features. Accordingly, all such changes and embodiments properly fall within the scope of the following claims.

We claim:

1. A method of modifying a boiler flue of a boiler to provide an internal gas bypass arrangement, the boiler flue having parallel flow gas paths with superheater surface located in one gas flow path, reheater surface located in another gas flow path and outlet flow control dampers provided in the superheater and reheater gas flow paths, the boiler flue having a plurality of tube banks having multiple tube bank inlets and multiple tube bank outlets within the parallel gas flow paths within the boiler setting, comprising the steps of:

removing tubes from at least one of the tube banks to create a void within the tube bank;

installing a bypass flue within the boiler setting in the void from the inlet of the tube bank to the outlet of the tube bank for transporting flue gas there through; and installing a damper within the bypass flue for controlling a pre-selected portion of the flowing flue gas through the bypass flue.

2. The method of claim 1, wherein the boiler flue has front and rear walls, and the step of installing the bypass flue comprises the step of attaching a pair of plates between the front and rear walls of the boiler flue.

3. The method of claim 1, wherein the boiler flue has side walls, and the step of installing the bypass flue comprises attaching a pair of plates between the side walls of the boiler flue.

4. The method of claim 1, wherein the step of installing the bypass flue comprises providing an integral flue sleeve in the void to totally encase the flue gas path.

5. The method of claim 1, comprising the steps of removing tubes from multiple tube banks to create a plurality of voids within the tube banks and installing multiple bypass flues within the boiler setting in the voids from the inlets of the tube banks to the outlets of the tube banks for transporting flue gas there through.

* * * * *